US005899162A

United States Patent [19]

Beaupréet al.

[11] Patent Number: 5,899,162

[45] Date of Patent: May 4, 1999

[54] TANKER RECONSTRUCTION

[75] Inventors: Richard C. Beaupré; Réjean Verreault, both of Les Méchins, Canada

[73] Assignee: Les Industries Verreault (1991) Inc., Les Mechins, Canada

[21] Appl. No.: 08/952,737

[22] PCT Filed: May 26, 1995

[86] PCT No.: PCT/CA95/00312

§ 371 Date: Nov. 25, 1997

§ 102(e) Date: Nov. 25, 1997

[87] PCT Pub. No.: WO96/37401

PCT Pub. Date: Nov. 28, 1996

[51] Int. Cl.[6] ..... B63B 25/12

[52] U.S. Cl. ..... 114/74 A; 114/74 R

[58] Field of Search ..... 114/65 R, 72, 114/73, 74 R, 74 A, 74 T

[56] References Cited

U.S. PATENT DOCUMENTS

| | | |
|---|---|---|
| 424,508 | 4/1890 | Shone . |
| 1,319,462 | 10/1919 | Daugherty . |
| 2,298,661 | 10/1942 | Swanson . |
| 3,021,808 | 2/1962 | Henry . |
| 3,332,386 | 7/1967 | Massac . |
| 3,631,832 | 1/1972 | Rodriguez . |
| 3,671,315 | 6/1972 | Iarossi . |
| 3,848,559 | 11/1974 | Tarossi . |
| 4,030,438 | 6/1977 | Telfer . |
| 4,162,658 | 7/1979 | Okabe et al. . |
| 4,660,491 | 4/1987 | Murata et al. . |
| 5,085,161 | 2/1992 | Cuneo et al. . |
| 5,158,031 | 10/1992 | Arnett et al. . |
| 5,189,975 | 3/1993 | Zednik et al. . |
| 5,203,272 | 4/1993 | Kassinger et al. . |
| 5,218,919 | 6/1993 | Krulikowski et al. . |
| 5,225,812 | 7/1993 | Faghri . |
| 5,477,797 | 12/1995 | Stuart . |

OTHER PUBLICATIONS

Schiff Und Haven, Meissner & Jensen, Sep. 1994.
Translation Into English Of Schiff Und Haven, Meissner & Jensen.

*Primary Examiner*—Ed Swinehart
*Attorney, Agent, or Firm*—Robert A. Wilkes

[57] ABSTRACT

A method of reconstructing a liquid carrying tank vessel, such as an oil tanker, and to the reconstructed vessel whereby a tank vessel constructed with a single bottom hull is reconstructed to a double bottom hull configuration at least over the hull portion including the cargo tanks, and to the reconstructed vessel thereby obtained. The original hull is separated at a point where the bow curve meets the midships section of the hull. A new section is inserted which follows the curvature of the original bows, and increases both the beam and draft. A new double bottom is applied over the remainder of the cargo tank carrying space of the hull, which is tapered in to meet the curve of the stern section. The new section can be fabricated with, or without, a double bottom, depending on its intended use.

12 Claims, 2 Drawing Sheets

TANKER RECONSTRUCTION

FIELD OF THE INVENTION

This invention relates to a method of reconstructing a liquid carrying tank vessel, such as an oil tanker, and to the reconstructed vessel. More particularly, this invention relates to a method whereby a tank vessel constructed with a single bottom hull is reconstructed to a double bottom hull configuration at least over the hull portion including the cargo tanks, and to the reconstructed vessel thereby obtained.

DESCRIPTION OF THE PRIOR ART

Over the past few years, at least in part as a consequence of several major ecological disasters involving tank vessels carrying oil or oil products, it has become apparent that the transport of oils chemicals, oil products, and similar materials in single hulled vessels is undesirable. When such a hull is involved in an accident the cargo tanks within the hull inevitably are breached, and the cargo escapes, usually into the sea or other waterway. This is the case for both liquid cargoes, such as crude oil, and bulk loaded particulate cargoes. The action of a tidal or current flow only serves to exacerbate the problem, as it causes the released pollutants to spread further.

Further, as a vessel ages, be it a tanker or anything else, its hull plates get thinners due to the combined effects of erosion and corrosion. In order to counter this effect, there are regulations specifying the minimum thicknesses required for the outer hull plating of vessels, including single hulled tankers. These minimum thicknesses have to be somewhat thinner than the original hull plate thickness that was used when the vessel was built. Consequently an older single hull vessel presents a somewhat greater risk than a newer vessel, quite simply because its thinned outer plates are more easily punctured.

The ship building art is replete with designs for vessels which are built new with a double hull. An early example is the hull described by Shone, in U.S. Pat. No. 424,508 of 1890. There are many later ones, such as Rodriguez, U.S. Pat. No. 3,631,832; Telfer, U.S. Pat. No. 4,030,438; Murata et al, U.S. Pat. No. 4,660,491; Cuneo et al, U.S. Pat. No. 5,085,161; and Arnett et al, U.S. Pat. No. 5,185,031. In all of these patents, a double hull construction technique is described which is to be used in constructing a new hull. None of these methods appear to be relevant to reconstructing a single bottom hull into a double bottom one.

It has also been proposed to make bulk liquid carrying vessels more resistant to hull puncture by providing a flexible liner within the cargo tanks. Liners of this type are described by Kassinger et al, U.S. Pat. No. 5,203,272 and Faghri, U.S. Pat. No. 5,225,812. In Kassinger the liquid liners are suspended from the vessel deck line, thus providing a double bottom of sorts, so that impact of the hull on, say, a rock might puncture the hull, but leave the liner intact. As described, there is a space around the liners between them and the cargo tanks, which will allow the liners to sway laterally with the motion of the ship. What effects such motion might have on ship stability are not discussed. Further, as there is free space between the cargo tanks and the sides and bottoms of the liners mounted within the cargo tanks, the bulk capacity of the vessel is diminished. In Faghri the liners are attached to the cargo tank walls, which include the inboard surfaces of the hull. Faghri also describes sensors which are intended to detect any leakage into the tank space through the liner.

It has also been proposed to add an outer casing to the hull of a vessel, usually, to quote Swanson in U.S. Pat. No. 2,298,661 "to protect the ship against the explosive effect of torpedoes, mines, and other destructive agents". Krulikowski, in U.S. Pat. No. 5,218,919 also describes a way of strengthening a hull for essentially the same purpose. These proposals always seek to contain and to dissipate the energy associated with the impact without exposing the underlying hull to damage. Krulikowski proposes to apply his technique to protecting tankers. Whilst the radical rebuilding method proposed by Krulikowski no doubt is effective, it is extremely expensive to put into practice. For examples a three layer plate laminate with energy absorbing joints is specified for the new outer bottom plating. These methods involving casing a major part of the hull wetted area also have the disadvantage that there is considerable change, usually for the worse, in the hull shape.

Zednik, in U.S. Pat. No. 5,189,975, proposes to reconstruct a single bottom hull into a double bottom one by slicing apart the cargo tank part of the hull horizontally some distance above the hull bottom plating, and vertically at its ends. Zednik then inserts both a new horizontal layer of plate together with specified vertical internal plate within the outermost cargo tanks. Although the overall width of the vessel is maintained, the draft is increased. However, it is clear that Zednik is not seeking to provide a conventional double hull as the result of reconstruction, as the new horizontal layer of plate is added about a third of the way up the hull from the bottom. Zednik recommends using the strengthened space below the inserted deck as cargo carrying capacity, rather than for carrying ballast, until such time as "international shipping regulations someday so require". As soon as this is done, and the space below the inserted deck is used for ballast, the cargo carrying capacity of the vessel is diminished by the volume turned over to ballast. Further, Zednik appears to give little attention to the fact that it is only the central portion of the vessel that is deepened, by increasing the height of the tank portion, without making any changes in the bow or stern portion of the ship. Consequently, since the vessel draft will increase, the freeboard of both the bow and stern portions of necessity is decreased by the same amount.

SUMMARY OF THE INVENTION

There is still therefore a need for a simple and relatively inexpensive procedure whereby an existing vessel hull can be reconstructed into a double hull format without affecting overall ship stability, retaining as much as possible the original underwater shape, and without diminishing the cargo carrying capacity of the vessel. This invention seeks to provide such a procedure.

In broad outline, this invention contemplates a procedure wherein as a first step, the bow portion is detached from the remainder of the hull at a point just before where the bow curve shape is merged into the substantially straight side portion of the hull. The detached portion is moved forward a short distance, and a new hull section created to fill the gap. The new section continues the bow curve, and has the effect of increasing the beam of the original hull shape. The inserted section also increases the depth of the hull below the original keel. A new outer double bottom is then fabricated around the remainder of the hull following the hull shape established by the newly inserted section, and covering all of the cargo tank spaces. Aft of the cargo tank spaces, the added outer double bottom is tapered in to meet the existing stern end shape of the vessel. The increase in beam and draft in the inserted new hull section is selected to provide a new outer double bottom of suitable depth on both the sides and bottom of the vessel over the hull portion containing the cargo tanks. The overall vessel shape is largely retained, and the carrying capacity increased by the volume of the new section inserted aft of the original bow section. Additionally, since the added outer shell of the double bottom is created around an existing watertight hull, the existing hull provides a continuous separation between the space within the double bottom and the cargo tanks. This new space therefore can easily utilised for ballast without any risk of contamination of or from the cargo tanks. Further, if the new cargo spaces in the inserted section are to be used as additional tank space, the inserted section is fabricated with a double bottom.

In one broad embodiment this invention seeks to provide a method of reconstructing a tank vessel having a hull including a bow sections a midships cargo tank section and a stern section comprising the steps of:

(i) separating the bow section from the midships section at a point adjacent the aft end of the bow curve;

(ii) inserting an additional hull section between the separated bow section and the midships section which conforms to the shape of the bow section at its forward end;

(iii) incorporating the inserted section into the hull structure by attachment to the bow and midships sections at each end; and (iv) applying an outer double bottom separated from and attached to the sides and bottom of the midships section extending aft from the inserted section to a point astern of the cargo tanks in the midships section; wherein:

(a) the inserted section substantially maintains the bow curve;

(b) the inserted section increases in both the beam and draft directions to provide a substantially smooth outer hull surface joining the bow section to the outer double bottom;

(c) the outer double bottom conforms to the shape of the midships section; and (d) the outer double bottom is tapered in to the existing side and bottom hull surface of the stern section aft of the cargo holding tanks.

In an alternative broad embodiment this invention seeks to provide a tank vessel having a hull including a bow section, a midships cargo tank section and a stern section reconstructed to include:

(i) an inserted additional hull section between the bow section and the midships section which conforms to the shape of the bow section at its forward end; and (ii) an applied outer double bottom section separated from and attached to the sides and bottom of the midships section extending aft from the inserted section to a point astern of the cargo tanks; wherein:

(a) the inserted section substantially maintains the bow curve;

(b) the inserted section increases in both the beam and draft directions to provide a substantially smooth outer hull surface joining the bow section to the outer double bottom;

(c) the outer double bottom conforms to the shape of the midships section; and (d) the outer double bottom is tapered in to the existing side and bottom hull surface of the stern section aft of the cargo holding tanks.

Preferably the inserted section is fabricated with a double bottom which is in communication with the space between the applied outer double bottom and the original bottom of the vessel.

Preferably, in the inserted section the deck level and freeboard heights of the bow section and of the midships section are maintained.

Preferably, the outer double bottom conforms to the shape of the midships section.

Preferably the only access to the space between the original vessel hull and the double bottom is provided at its ends and not from within the cargo tank spaces.

BRIEF DESCRIPTION OF THE DRAWINGS

One embodiment of the invention as applied to a tank vessel will now be described by way of reference to the drawings in which.

DESCRIPTION OF THE EMBODIMENT

Figure 1:
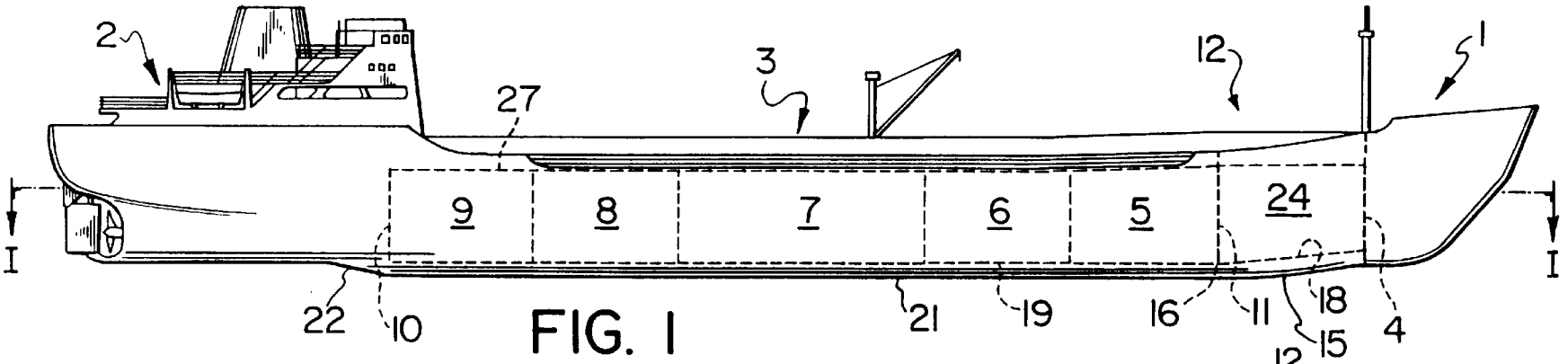
FIG. 1 shows a side elevation of a tank ship modified according to the invention.

In the drawings, the relevant parts of the original vessel, and the parts added during reconstruction are both shown.

Figure 2:
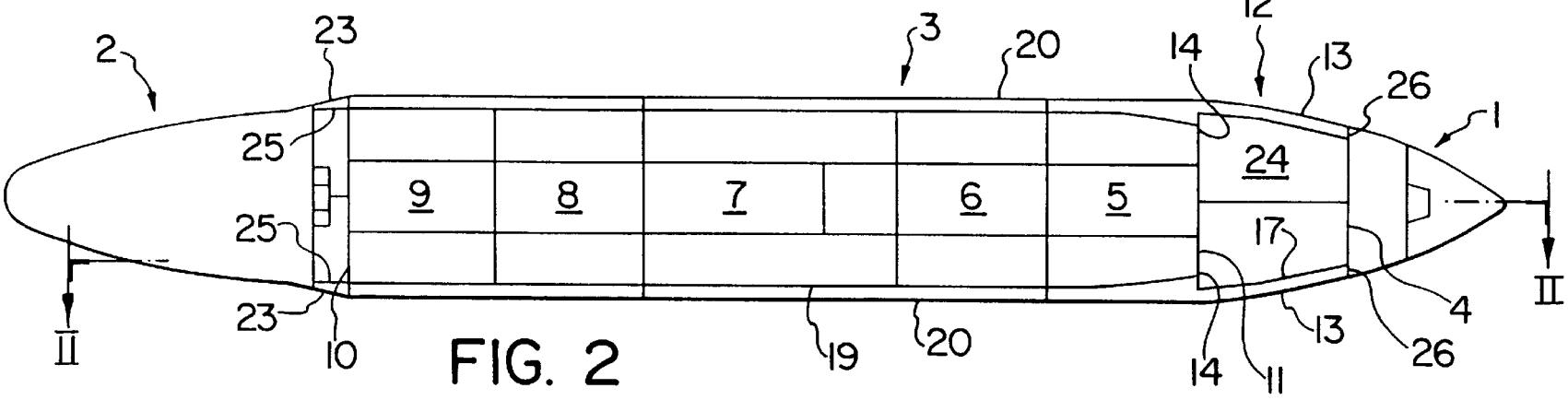
FIG. 2 shows a section on line I—I of FIG. 1.

Referring first to FIGS. 1 and 2, the original bow section is at 1, the original stern section is at 2, and the midships section is at 3. These sections contain the usual shipborne equipment such as anchors, a rudder, a screw, the ship's engines, crew's quarters, pumping systems for the cargo, and so forth. As all of these are retained essentially unchanged when reconstructing the vessel, they are not discussed further. The original bow section extends aft to the line shown at 4. In the original ship before rebuilding, this bow section was attached to the remainder of the hull at the line 11.

Forward of the stern section, within the original midships section 3, are cargo tank spaces, shown typically at 5, 6, 7, 8, and 9. In practise, these tank spaces are internally subdivided into the cargo holding tanks, and will also include spaces utilised for pumps and so forth to handle the cargo. The stern section extends forward to end at the line 10, and the midships section comprises the part of the hull between 10 and 11. Both the bow section and the stern section are not double bottomed, and this is not changed during the reconstruction except for the forward portion of the stern section.

Figure 3:
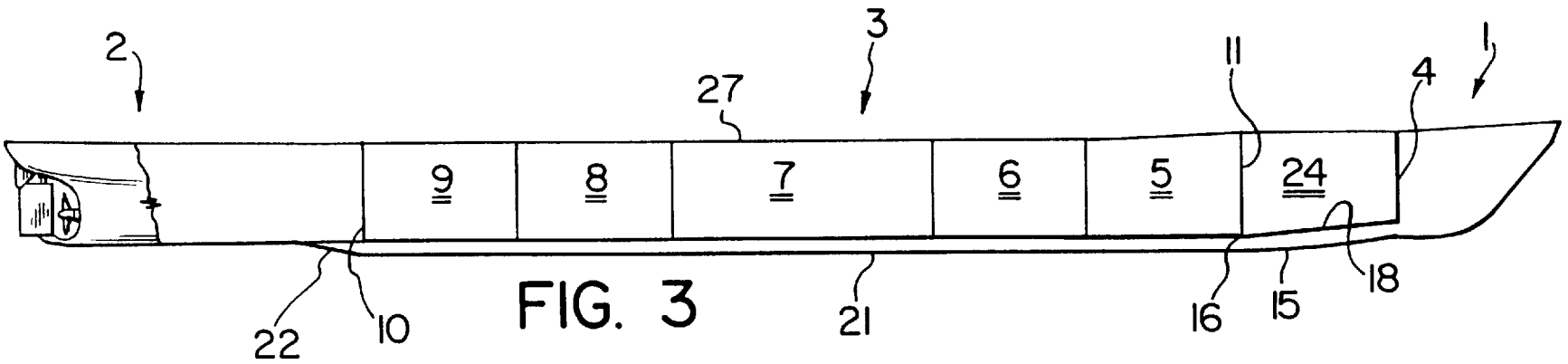
FIG. 3 shows a partial midships section of the hull shown in FIG. 1, on the line II—II, from which the deck structures and most internal details are omitted.

The first step of the reconstruction process is to sever the original hull along a cross-sectional plane essentially to separate the ends 4 and 11 of the bow and midships sections respectively. After separation, the bow is moved away from the remainder of the hull far enough to allow for the new insert section 12 to be put in place. In plan, as can be seen in FIG. 2, the inserted section preserves as much as is possible the original bow curve as at 13, which causes an increase in the vessel beam at the junction with the midships section, as the original beam is somewhat narrower than the inserted section as at 14. In a similar fashion, the draft of the inserted section increases so that the new outer bottom line as at 15 is lower than the original fore end bottom of the midships section, as at 16 (see FIG. 3). The inserted section 12 shown includes a double bottom as built with interior side walls 17 and bottom surface 18. As shown the side walls 17 follow the bow curve and are not aligned with the original hull at 14; it is however convenient for the bottom surface 18 to be in alignment with the original midships bottom 19.

The other step in the reconstruction process is to apply a new outer double bottom shell to the cargo tank space of the original midships section of the vessel. As can be seen from FIGS. 2 and 3, this comprises new side plating 20 and bottom plating 21 spaced apart from and attached to the original vessel hull sides and bottom 19. The plate thicknesses used, and additional internal framing incorporated within the added double bottom space, are chosen to conform to good shipbuilding practises. Due to the beam and draft increases provided in the inserted section 12, the added double bottom 20,21 joins smoothly to it, thus providing a reasonably smooth uninterrupted underwater shape to the ship extending aft to the end of the midships section.

As the double bottom is only required to extend over the cargo tank spaces in the midships section, it is not continued over the stern section. Aft of the stern end 10 of the midships section, the added double bottom plating is tapered in over a suitable distance, as at 22 and 23, on the bottom and sides of the hull.

In these steps it is not necessary to breach in any way the outer water tight envelope of the original hull, which is retained as the inner skin of the double bottom applied to the midships section. Any necessary access apertures for the double bottom spaces are provided in either or both of the area 25 of the stern section or from the bow section at the area 26. If desired, access can also be provided at main deck level.

As shown, additional cargo tanks 24 are included in the inserted section 12, and a double bottom is provided for it. If this newly added space is to be put to some other purpose, a double bottom might not need to be incorporated into it. It is also convenient for the inserted section to maintain the deck level and freeboard heights of the adjacent bow section.

As shown, the added double bottom extends substantially up to the original main deck level 27.

We claim:

1. A method of reconstructing a tank vessel having a hull including a bow section, a midships cargo tank section and a stern section comprising the steps of:

(i) separating the bow section from the midships section at a point adjacent the aft end of the bow curve;

(ii) inserting an additional hull section between the separated bow section and the midships section which conforms to the shape of the bow section at its forward end;

(iii) incorporating the inserted section into the hull structure by attachment to the bow and midships sections at each end; and (iv) applying an outer double bottom separated from and attached to the sides and bottom of the midships section extending aft from the inserted section to a point astern of the cargo tanks in the midships section; wherein:

(a) the inserted section substantially maintains the bow curve;

(b) the inserted section increases in both the beam and draft directions to provide a substantially smooth outer hull surface joining the bow section to the outer double bottom, (c) the outer double bottom conforms to the shape of the midships section; and (d) the outer double bottom is tapered in to the existing side and bottom hull surface of the stern section aft of the cargo holding tanks.

2. A method according to claim 1 wherein the inserted section is fabricated with a double bottom which is in communication with the space between the double bottom and the sides and bottom of the midships section.

3. A method according to claim 1 wherein in the inserted section the deck level and freeboard heights of the bow section and of the midships section are maintained.

4. A method according to claim 1 wherein the outer water tight envelope of the original hull is retained intact as the inner skin of the double bottom applied to the midships section.

5. A method according to claim 1 wherein any necessary access apertures for the double bottom spaces are provided in a location chosen from the group consisting of the stern section, the inserted section, and the bow section.

6. A method according to claim 1 wherein the outer double bottom conforms to the shape of the midships section.

7. A tank vessel having a hull including a bow section, a midships cargo tank section and a stern section reconstructed to include:

(i) an inserted additional hull section between the bow section and the midships section which conforms to the shape of the bow section at its forward end; and (ii) an applied outer double bottom section separated from and attached to the sides and bottom of the midships section extending aft from the inserted section to a point astern of the cargo tanks; wherein:

(a) the inserted section substantially maintains the bow curve;

(b) the inserted section increases in both the beam and draft directions to provide a substantially smooth outer hull surface joining the bow section to the outer double bottom;

(c) the outer double bottom conforms to the shape of the midships section; and (d) the outer double bottom is tapered in to the existing side and bottom hull surface of the stern section aft of the cargo holding tanks.

8. A vessel according to claim 7 wherein the inserted section includes a double bottom which is in communication with the space between the double bottom and the sides and bottom of the midships section.

9. A vessel according to claim 7 wherein in the inserted section the deck level and freeboard heights of the bow section and of the midships section are maintained.

10. A vessel according to claim 7 wherein the intact outer water tight envelope of the original hull comprises the inner skin of the double bottom applied to the midships section.

11. A vessel according to claim 7 including access apertures for the double bottom spaces in a location chosen from the group consisting of the stern sections the inserted sections and the bow section.

12. A vessel according to claim 7 wherein the outer double bottom conforms to the shape of the midships section.

* * * * *